US005553192A

United States Patent [19]

Hayata

[11] Patent Number: 5,553,192

[45] Date of Patent: Sep. 3, 1996

[54] APPARATUS FOR NOISE REMOVAL DURING THE SILENCE PERIODS IN THE DISCONTINUOUS TRANSMISSION OF SPEECH SIGNALS TO A MOBILE UNIT

[75] Inventor: Toshihiro Hayata, Tokyo, Japan

[73] Assignee: NEC Corporation, Tokyo, Japan

[21] Appl. No.: 133,864

[22] Filed: Oct. 12, 1993

[30] Foreign Application Priority Data

Oct. 12, 1992 [JP] Japan ..... 4-272173

[51] Int. Cl.[6] ..... G10L 9/00

[52] U.S. Cl. ..... 395/237; 395/2.71; 395/2.24; 395/2.28

[58] Field of Search ..... 395/2, 2.1, 2.17, 395/2.23, 2.24, 2.28, 2.29, 2.35, 2.37, 2.42, 2.67, 2.71, 273; 381/41, 46, 47, 51

[56] References Cited

U.S. PATENT DOCUMENTS

| | | | |
|---|---|---|---|
| 2,938,079 | 5/1960 | Flanagan | 381/50 |
| 4,331,837 | 5/1982 | Soumagne | 395/2.37 |
| 4,726,037 | 2/1988 | Jayant | 395/2.37 |
| 4,731,846 | 3/1988 | Secrest et al. | 395/2.37 |
| 5,293,448 | 3/1994 | Honda | 395/2.28 |
| 5,323,337 | 6/1994 | Wilson et al. | 395/2.42 |
| 5,369,728 | 11/1994 | Kosaka et al. | 395/2.73 |

OTHER PUBLICATIONS

*ETSI–GSM* 06.11, "Substitution and Mutingof Lost Frames for Full–Rate Speech Traffic Channels," ver. 3.0.0., 1991.

*ETSI–GSM* 06.12, "Comfort Noise Aspects for Full–Rate Speech Traffic Channels," ver. 3.0.1, Feb. 1992.

Lenk, *McGraw Hill Circuit Encyclopedia and Troubleshooting Guide,* vol. 1, McGraw–Hill, New York, New York, 1993, pp. 85–86.

Holmes, *Speech Synthesis and Recognition,* Chapman & Hall, London, Englan, 1988, pp. 61–63.

Parsons, *Voice and Speech Processing,* McGraw–Hill, New York, New York, 1987, pp. 151–152 and 345–358.

"Discontinuous Transmission (DTx) for Full–Rate Speech Traffic Channels", ETS/TC GSM, GSM 06.31, Version 3.1.0, Mar. 1990, pp. 1–13.

*Primary Examiner*—Allen R. MacDonald
*Assistant Examiner*—Michael A. Sartori
*Attorney, Agent, or Firm*—Sughrue, Mion, Zinn, Macpeak & Seas

[57] ABSTRACT

The disclosure is to eliminate discomforting background noise regenerated at a receive side (viz., a base station) in a mobile radio communications system wherein discontinuous transmission (DTX) is utilized. When speech pause is detected at the receive side, synthesis filter coefficients are produced using a background noise code which has been transmitted from a mobile unit. Subsequently, a Q value of the synthesis filter is measured using the above-mentioned synthesis filter coefficients. If the Q value is larger than a threshold level, each of the filter coefficients is lowered by a predetermined value. Thus, the regenerated discomforting background noise can effectively be reduced.

3 Claims, 3 Drawing Sheets

APPARATUS FOR NOISE REMOVAL DURING THE SILENCE PERIODS IN THE DISCONTINUOUS TRANSMISSION OF SPEECH SIGNALS TO A MOBILE UNIT

BACKGROUND OF THE INVENTION

1. Field of the Invention

The present invention relates generally to a speech signal demodulator provided in a base station in a mobile radio communications system, and more specifically to such a demodulator for demodulating speech signals applied thereto from a mobile unit using discontinuous transmission (DTX) techniques.

2. Description of Related Art

It is well known in the art to use discontinuous transmission (DTX) for reducing the power consumption of a mobile unit (or mobile station). The discontinuous transmission, which is also called VOX (voice operated transmission), allows a radio transmitter to be switched off most of the time during speech pauses for the purposes of power conservation.

The discontinuous transmission was disclosed in a paper entitled "Discontinuous Transmission (DTX) for full-rate speech traffic channels" released by ETSI/PT 12, GMS Recommendation 06.31, pages 1–13, January 1990.

Before turning to the present invention it is deemed advantageous to briefly discuss the discontinuous transmission with reference to FIG. 1.

A transmitter of a mobile station (not shown) transmits speech code sequences on a frame by frame basis while a speaker at the mobile unit is talking. As shown in FIG. 1, one frame has a time interval of 20ms (224 bits) by way of example. When the transmitter of a mobile unit detects that a speaker stops talking, the transmitter sends a post-amble to the corresponding base station. As shown, the post-amble includes two frame signals one of which is a unique word (denoted by UW1) and the other is an acoustic background noise code sequence.

Following this, the transmitter is switched off for a predetermined time duration (60 frames for example) if the speaker at the mobile unit remains silent. After the above-mentioned predetermined time duration (60 frames) elapses, the transmitter again dispatches the unique word UW1 which is followed by a new acoustic background noise code sequence. Thus, the base station receives the new background noise code sequence and updates the previously transmitted noise code sequence. The noise which is regenerated at the receive side (viz., base station) is referred to as "comfort noise". In the case where the speaker at the mobile unit continues to be silent, the combination of the unique word UW1 and a new background noise code sequence is repeatedly transmitted every 60 frames.

On the other hand, if the mobile unit detects that the speaker begins to speak again, the transmitter of the mobile unit instantly sends another unique word UW2 (viz., preamble) to the base station. Immediately thereafter, the mobile unit transmits speech code sequences as best illustrated in FIG. 1.

As mentioned above, if the speaker at the mobile unit stays silent for a long time, the background noise code sequences are subsequently transmitted for updating purposes. In this case, it is not seldom that a given reproduced background noise is such as to cause discomfort to the listening party at the base station. Further, it is often the case, however, that once a discomforting background noise is transmitted, this situation tends to continue for some time. Accordingly, even though the discomforting background noise issues for a mere 60 frames, it is still desirable to eliminate the same.

FIG. 2 is a block diagram showing a conventional demodulator. Speech and/or noise code sequences are transmitted, together with the unique words UW1 and UW2, from a mobile unit (not shown) to a decoder 10 which forms part of the arrangement shown in FIG. 2. A decoded code sequence is then simultaneously applied to an excitation signal generator 12, a synthesis filter coefficient generator 14, and a speech pause/start discriminator 16.

An excitation signal which is outputted from the signal generator 12, is applied to a synthesis filter 18. As is well known in the art, if the synthesis filter 18 takes the form of an all-pole type filter, then a transfer function of the filter 18 is given using a z transform. That is, $$H(z) = 1/\left(1 - \sum_{i=1}^{N} \alpha_i Z^{-i}\right) \tag{1}$$

where N is the predetermined order of the filter, and $\alpha_i$ denotes coefficients of the synthesis filter which are applied to the filter 18.

The synthesis filter coefficient generator 14 is well known in the art and hence, the details thereof will not be described for the sake of simplicity.

The speech pause/start discriminator 16 is arranged to detect the above-mentioned unique words UW1 and UW2. If the discriminator 16 detects the uniqu word UW2, the discriminator 16 supplies a switch 20 with a control signal C1 which assumes a logic 1 level merely by way of example. The switch 20, in response to the control signal C1 assuming a logic 1 level, steers the output of the coefficient generator 14 to the synthesis filter 18. Thus, the output of the synthesis filter 18 is applied to the next stage, viz., a speech signal output circuit 22 from which a reproduced speech signal or background noise is outputted to a speaker driver (not shown) for example. The control signal C1 is also applied to a controller 24. However, the controller 24 is not responsive to the control signal C1 assuming a logic 1 level in this particular case.

On the other hand, in the case where the discriminator 16 detects the unique word UW1, the discriminator 16 outputs the control signal C1 which in turn assumes a logic 0 level. The switch 20 is responsive to this control signal C1 and applies the output of the generator 14 to the synthesis filter 18 and a memory 26.

Thus, the synthesis filter 18 reproduces the background noise which is applied to the output circuit 22 in the form of a comfort noise signal. On the other hand, the memory 26 stores the synthesis filter coefficients outputted from the generator 14. The controller 24, in response to the control signal C1 assuming a logic 0 level, instructs the memory 26 to apply the filter coefficients stored therein to the synthesis filter 18. If the speaker at the mobile unit remains silent, the above-mentioned operations continue while updating the content of the memory 26. When the discriminator 16 detects the unique word UW2, the aforesaid speech and noise signal synthesizing operations are resumed.

As above mentioned, if a given background noise induces displeasure to the listening party at the base station, he or she will quickly become annoyed.

The above-mentioned prior art has not addressed such a problem. Accordingly, it is highly desirable to eliminate this drawback inherent in the prior art.

SUMMARY OF THE INVENTION

It is an object of the present invention to provide an arrangement via which a discomforting background noise generation can effectively be avoided.

In brief, the above object is achieved by a technique for eliminating discomforting background noise regenerated at a receive side (viz., a base station) in a mobile radio communications system which uses discontinuous transmission (DTX). When a speech pause is detected at the receive side, synthesis filter coefficients are produced using a background noise code which has been transmitted from a mobile unit. Subsequently, a Q value of the synthesis filter is measured using the above-mentioned synthesis filter coefficients. If the Q value is larger than a threshold level, each of the filter coefficients is lowered by a predetermined value. Thus, the regenerated discomforting background noise can effectively be reduced.

An aspect of the present invention resides in an arrangement for demodulating speech code sequences discontinuously transmitted from a mobile unit and for demodulating background noise code sequences transmitted from the mobile unit while the speech code sequences pause, the arrangement receiving speech pause/start indicators, the arrangement comprising: first means for generating synthesis filter coefficients using either of the speech code sequence and the background noise code sequence; second means for synthesizing either of speech signals and background noise signals using the synthesis filter coefficients; third means for discriminating speech pause and speech start using the speech pause/start indicators; fourth means for estimating Q value of the second means using the synthesis filter coefficients and generating an estimated Q value if the third means discriminates the speech pause; and fifth means for reducing levels of the synthesis filter coefficients if the estimated Q value is larger than a threshold level, the fifth means supplying the second means with the reduced synthesis filter coefficients.

BRIEF DESCRIPTION OF THE DRAWINGS

The features and advantages of the present invention will become more clearly appreciated from the following description taken in conjunction with the accompanying drawings in which.

DETAILED DESCRIPTION OF THE PREFERRED EMBODIMENTS

Before discussing the instant invention, a principle underlying the instant invention will first be described.

During the study of eliminating the above-mentioned problem, the inventor concluded that the discomforting noise resulted from the fact that the corresponding incoming noise code sequence raised a Q value of the synthesis filter. Thus, if the Q value is lowered in order to flatten the frequency spectrum in the vicinity of the peak point of the synthesis filter, the problem will be effectively overcome.

The present invention is based on the above-mentioned principle.

Figure 1:
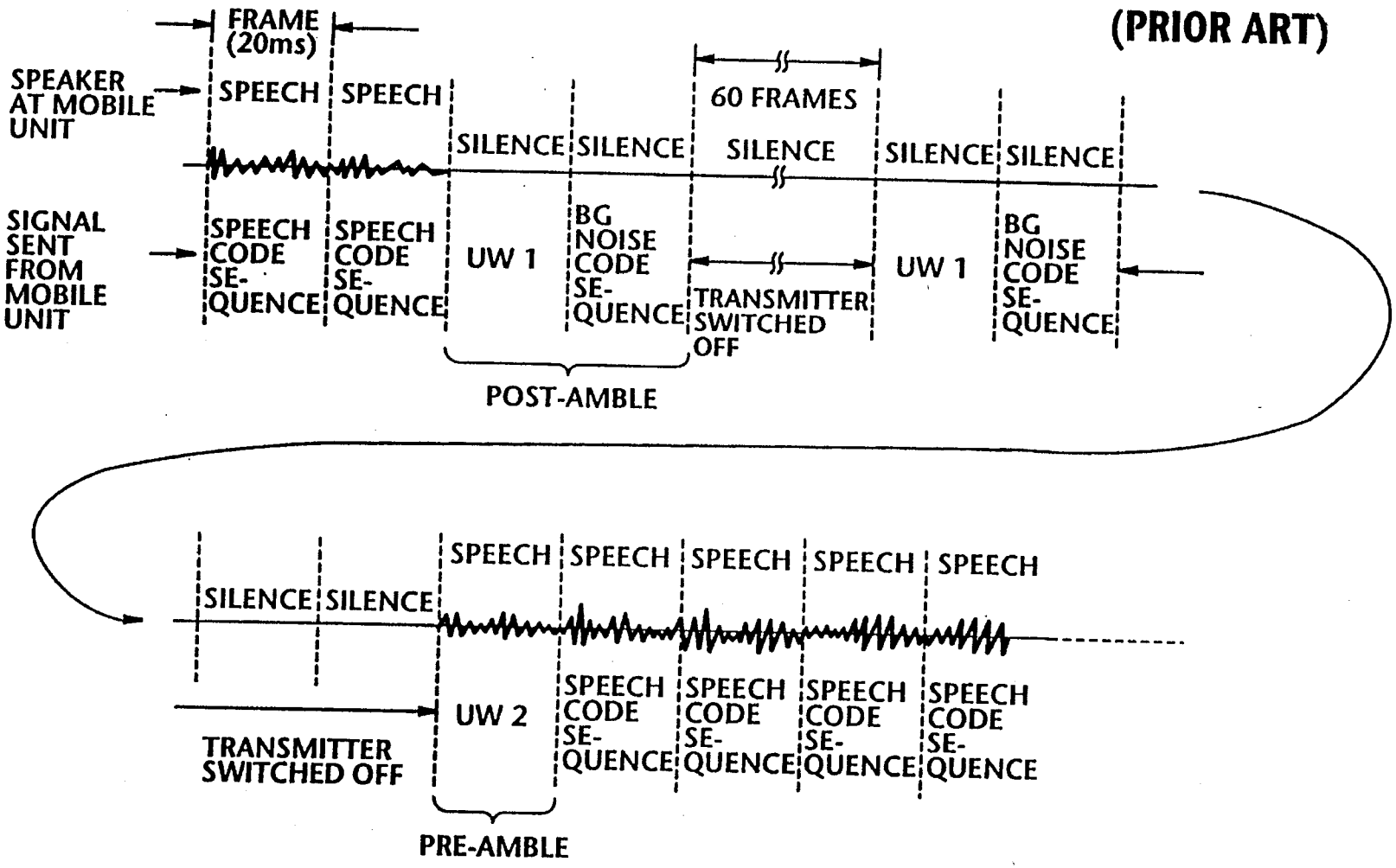
FIG. 1 (PRIOR ART)
FIG. 1 is a schematic diagram which illustrates the discontinuous transmission used in a mobile communications system referred to in the opening paragraphs of the instant disclosure.
Figure 2:
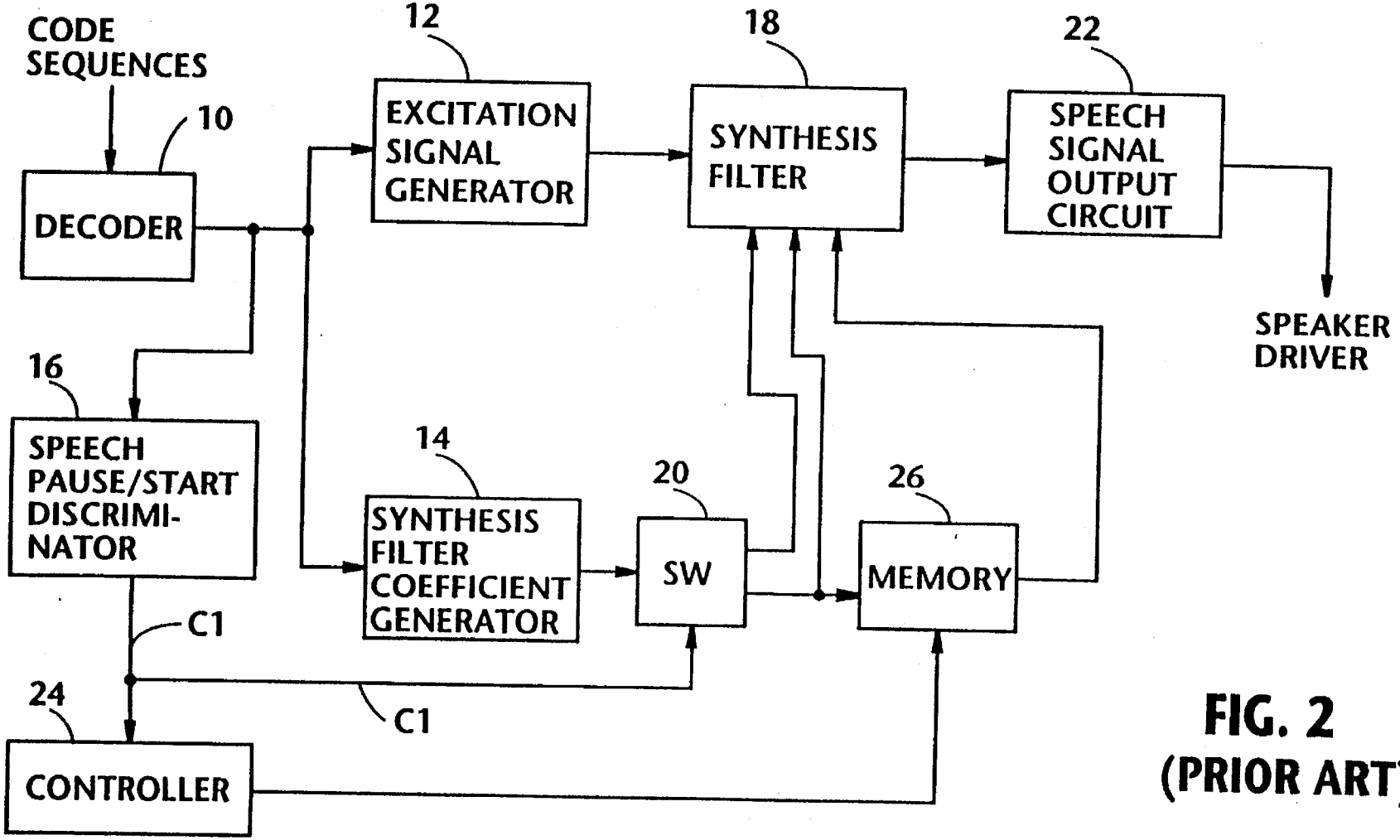
FIG. 2 (PRIOR ART)
FIG. 2 is a block diagram showing a conventional demodulator which has been described in the opening paragraphs of the instant disclosure.
Figure 3:
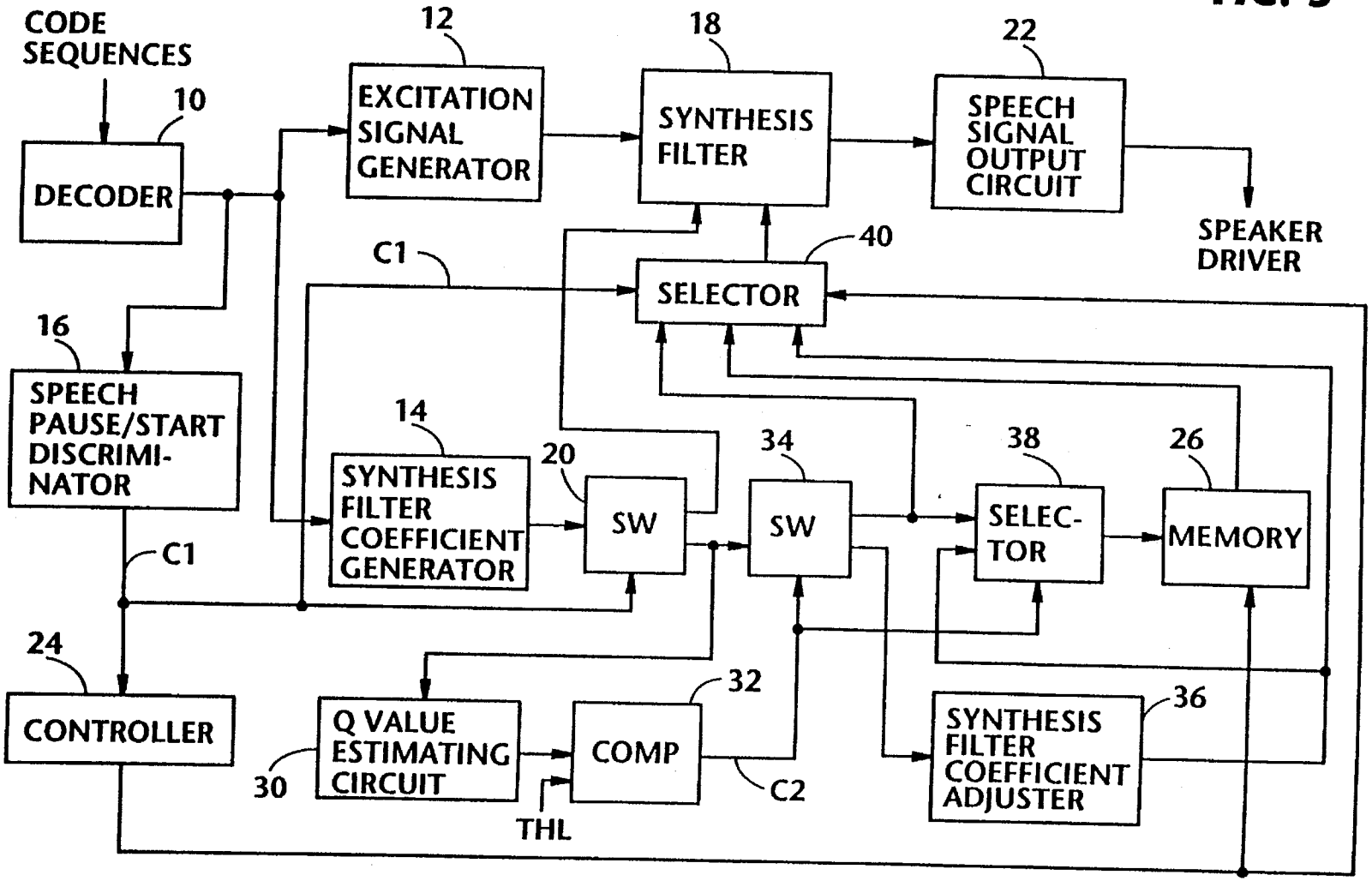
FIG. 3 is a block diagram showing a demodulator embodying the present invention.

Reference is now made to FIG. 3. The arrangement of FIG. 3 differs from that of FIG. 2 in that the former arrangement additionally includes a Q value estimating circuit 30, a comparator 32, a switch 34, a synthesis filter coefficient adjuster 36, and two selectors 38 and 40.

Each of the blocks already discussed in connection with FIG. 2 will be referred to only in the instances wherein it is necessary to describe the instant invention.

As mentioned above, when the discriminator 16 distinguishes the unique word UW1, the control signal C1 assuming a logic 0 level is applied to the switch 20 and the controller 24. In addition to this, the control signal C1 is applied to the selector 40. The switch 20 is responsive to the logic 0 input level and applies an output of the generator 14 (viz., the filter coefficients for synthesizing the background noise) to the Q value estimating circuit 30 and the switch 34.

The estimating circuit 30 generates an estimated Q value of the synthesis filter 18 using the filter coefficients applied thereto from the generator 14 via the switch 20. Following this, the comparator 32 compares the estimated Q value with a threshold level THL. The threshold level THL is previously determined based on the estimated Q value which may cause discomfort to the listening party at the base station side.

The Q value estimating circuit 30 is of a conventional one and is well known in the art. Thus, the details of the estimating circuit 30 will not be described for the sake of brevity.

If the estimated Q value is smaller than the threshold level THL, the background noise transmitted from the mobile unit is determined as not being of a nature which will induce any irritation to the listener coupled to the base station. In this instance, the comparator 32 issues a control signal C2 which assumes a logic 1 level (for example). The switch 34, in response to this control signal C2, routes the output of the generator 14 to the selector 40. Subsequently, the selector 40, in response to the control signal C1 assuming a logic 0 level, selects the output of the generator 14 and then applies same to the synthesis filter 18.

In the above-mentioned case, the selector 38 supplies the memory 26 with the filter coefficients outputted from the generator 14.

Thereafter, the controller 24 derives the filter coefficients stored in the memory 26 and applies same to the selector 40 on a frame by frame basis. In this instance, the selector 40 steers the filter coefficients obtained from the memory 26 toward the synthesis filter 18.

Contrarily, if the estimated Q value exceeds the threshold level THL, the background noise transmitted from the mobile unit is determined as being irritating or annoying the listener. Therefore, the comparator 32 issues the control signal C2 which assumes a logic 0 level. The switch 34, in response to this control signal C2, supplies the synthesis filter coefficient adjuster 36 with the filter coefficients from the generator 14.

The synthesis filter coefficients adjuster 36 operates in a manner which multiplies the filter coefficients $\alpha_i$ from the generator 14 by corresponding weighing coefficients $g_i$ (i=1, . . . , N) ($0<g_i<1$). The adjusted filter coefficients $\alpha_i*g_i$ (notation * indicating multiplication) are applied to the synthesis filter 18 via the selector 40. It should be noted that the selector 40 is ready to select the adjusted filter coefficients $\alpha_i*g_i$ under the control of the control signal C1 in this case. Further, the adjusted filter coefficients are applied to the memory 26 via the selector 38. Subsequently, the controller 24 controls the memory 26 such as to apply the adjusted filter coefficients stored therein to the selector 42 on a frame by frame basis. In this instance, the selector 40 steers the adjusted filter coefficients obtained from the memory 26 toward the synthesis filter 18.

In the case where the adjusted filter coefficients $\alpha_i * g_i$ are applied to the synthesis filter 18, the transfer function of the filter 18 is given by $$H(z) = 1/\left(1 - \sum_{i=1}^{N} \alpha_i g_i Z^{-i}\right) \quad (1)$$

The filter coefficients stored in the memory 26 are updated when the unique word UW1 is detected at the discriminator 16.

It will be understood that the above disclosure is representative of only one possible embodiment of the present invention and that the concept on which the invention is based is not specifically limited thereto.

What is claimed is:

1. An arrangement for demodulating speech code sequences discontinuously transmitted from a mobile unit and for demodulating background noise code sequences transmitted from said mobile unit while said speech code sequences pause, said arrangement receiving speech pause/start indicators, said arrangement comprising:

first means for generating synthesis filter coefficients using either of said speech code sequence or said background noise code sequence;

second means for synthesizing either of speech signals or background noise signals using said synthesis filter coefficients;

third means for discriminating speech pause and speech start using said speech pause/start indicators;

fourth means for estimating Q value of said second means using said synthesis filter coefficients and generating an estimated Q value if said third means discriminates said speech pause; and fifth means for generating reduced synthesis filter coefficients by reducing said synthesis filter coefficients if said estimated Q value is larger than a threshold level, said fifth means supplying said second means with said reduced synthesis filter coefficients.

2. An arrangement as claimed in claim 1, further including a comparator which is coupled to compare said estimated Q value with said threshold level, said comparator issuing a control signal indicative of a result of comparison, said fifth means being responsive to said control signal.

3. An arrangement as claimed in claim 1, further including a memory for storing said reduced synthesis filter coefficients, said reduced synthesis filter coefficients stored in said memory being applied to said second means at a predetermined time interval until being updated.

* * * * *